US005406805A

United States Patent [19]

Radermacher et al.

[11] Patent Number: 5,406,805

[45] Date of Patent: Apr. 18, 1995

[54] TANDEM REFRIGERATION SYSTEM

[75] Inventors: K. Reinhard H. Radermacher, Silver Spring; Kwangil Kim, Hyattsville, both of Md.; William L. Kopko, Springfield, Va.; Jurgen Pannock, Stevensville, Mich.

[73] Assignees: University of Maryland, College Park, Md.; The United States Environmental Production Agency, Washington, D.C.

[21] Appl. No.: 150,996

[22] Filed: Nov. 12, 1993

[51] Int. Cl.[6] ..... F25D 17/06; F25D 21/06

[52] U.S. Cl. ..... 62/81; 62/113; 62/179; 62/180; 62/198; 62/278; 62/513

[58] Field of Search ..... 62/81, 89, 113, 179, 62/180, 182, 186, 198, 199, 200, 278, 408, 513

[56] References Cited

U.S. PATENT DOCUMENTS

| | | | |
|---|---|---|---|
| 2,937,511 | 5/1960 | Mann | 62/198 |
| 3,359,751 | 12/1967 | Stevens | 62/186 |
| 3,786,648 | 1/1974 | Rice . | |
| 4,033,739 | 7/1977 | Ballarin . | |
| 4,240,263 | 12/1980 | Brendel . | |
| 4,416,119 | 11/1983 | Wilson et al. | 62/180 X |
| 4,439,998 | 4/1984 | Horvay et al. | 62/200 X |
| 4,910,972 | 3/1990 | Jaster . | |
| 4,918,942 | 4/1990 | Jaster . | |
| 4,936,113 | 6/1990 | Nivens . | |
| 4,966,010 | 10/1990 | Jaster et al. . | |
| 5,056,328 | 10/1991 | Jaster et al. . | |
| 5,103,650 | 4/1992 | Jaster . | |
| 5,109,678 | 5/1992 | Jaster et al. . | |
| 5,134,859 | 8/1992 | Jaster . | |
| 5,150,583 | 9/1992 | Jaster et al. . | |
| 5,157,943 | 10/1992 | Jaster et al. . | |
| 5,243,837 | 9/1993 | Radermacher et al. | 62/513 |

*Primary Examiner*—Harry B. Tanner

*Attorney, Agent, or Firm*—Oblon, Spivak, McClelland, Maier & Neustadt

[57] ABSTRACT

A refrigeration system for providing cooling to two or more compartments utilizing respective first and second evaporators. During the initial operation of a cooling cycle, the refrigerant is utilized for cooling the compartment (such as a fresh food compartment) which is to be maintained at a higher temperature as compared with another compartment (such as a freezer compartment). Cooling can thus be achieved by operating a fan in the fresh food compartment, even where the refrigeration system has not yet reached steady state after the compressor initially begins operating. After cooling has been achieved in the fresh food compartment, the refrigerant in the system has reached a state suitable for cooling of the freezer compartment, and the fan for the freezer evaporator is turned on while the fan for the fresh food compartment is turned off. As a result, a relatively simply refrigeration system is provided which is more efficient than conventional arrangements, particularly single-stage refrigeration systems. A defrosting cycle can also be accomplished with the fresh food fan operating, and with the freezer evaporator fan and compressor off. As the refrigerant evaporates in the fresh food evaporator during defrosting, a thermosiphon effect results in an exchange of refrigerant between the evaporators such that defrosting is accomplished without requiring a defrost heater.

18 Claims, 4 Drawing Sheets

TANDEM REFRIGERATION SYSTEM

BACKGROUND OF THE INVENTION

1. Field of the Invention

The invention relates to refrigeration systems, and particularly to refrigeration systems having two or more compartments which are to be cooled or maintained at different temperatures.

2. Discussion of the Background

Refrigeration systems having two or more compartments maintained at different temperatures are known for both domestic (household) and commercial (e.g., restaurants, stores, etc.) uses. Typically, it is desirable to maintain one compartment at a lower temperature than one or more other compartments such that various items can be maintained at appropriate temperatures. For example, a first compartment can be utilized for storing items at low temperatures, such as frozen foods, with a second compartment provided for storage at a temperature higher than that of the first compartment, for example a temperature suitable for fresh foods.

To achieve the different temperatures for the respective compartments, a single evaporator can be utilized for providing cold air to the respective compartments, with the respective temperatures determined based upon the amount of cold air provided for each compartment. However, it can be difficult to properly control the temperatures of each of the compartments with such an arrangement, particularly with changing ambient conditions and changes in the respective thermal loads of the compartments (e.g. door opening or introduction of warm food).

Systems have also been devised for two compartment refrigerators in which an evaporator is provided for each of the compartments. U.S. Pat. No. 5,150,583 to Jaster discloses an example of such an arrangement in which a pair of evaporators are provided for respective freezer and fresh food compartments. However, such an arrangement can be complicated in that the conditions of each of the evaporators must be controlled, thus increasing the complexity of the system, as well as increasing the cost to both manufacture and use the system. Accordingly, an improved refrigeration system is desired which can reliably cool two or more compartments economically and efficiently.

SUMMARY OF THE INVENTION

It is therefore an object of the present invention to provide an improved refrigeration system which can reliably maintain two or more compartments at desired temperatures.

It is a further object of the present invention to provide a refrigeration system in which two or more evaporators are utilized for maintaining two or more compartments at desired temperatures, with the refrigeration system having a relatively simple construction, and with the system economical both in terms of manufacturing costs and cost of operation.

These and other objects and advantages are achieved in accordance with the present invention in which first and second evaporators are provided for respective first and second compartments, with the evaporators maintaining the temperature inside the compartments within desired temperature ranges. For convenience, the system will be described in the context of a standard domestic refrigerator, having two compartments, the first a freezer compartment and the second a food or fresh food compartment. However, it is to be understood that the present invention is applicable to a variety of refrigeration systems, for example, systems having more than two compartments, or even systems in which the temperature in one of the compartments need not be maintained at below freezing.

In accordance with a significant aspect of the present invention, it has been recognized that during the initial operation of the system (i.e., when the compressor begins operating), the refrigerant can be utilized to provide cooling for the higher temperature compartment (e.g. a fresh food compartment), even though the state of the refrigerant is unacceptable for cooling of the freezer compartment. Thus, during initial operation of the compressor, the fresh food compartment can be cooled until the system reaches steady state. Once the food compartment is suitably cooled, and the system has reached steady state, the freezer compartment can then be cooled. As a result, the system is more efficient, since cooling occurs even before the system reaches steady state. In addition, the system is relatively simple since an evaporator for the food compartment can be directly connected in series to an evaporator for the freezer, and controls for varying the flow of the refrigerant through the respective evaporators are not needed. (Of course, it is also possible to add refrigerant flow controls to the system of the present invention if desired.) As will be described in further detail herein, the system also provides a convenient and efficient defrost cycle.

The major benefit of the present invention, as compared with known systems, resides in the energy savings (with savings of approximately 10–20% as compared with standard single-stage systems). The energy savings are achieved by: (1) operating the system with a single compressor; (2) providing two evaporators in series; (3) operating two evaporators at the same pressure level at any given time (although the pressure level may change, it is the same in both evaporators); and (4) operating only one evaporator fan at a time. Other aspects and advantages of the present invention will become apparent herein.

BRIEF DESCRIPTION OF THE DRAWINGS

A more complete appreciation of the invention and many of the attendant advantages thereof will become readily apparent from the following detailed description, particularly when considered in conjunction with the accompanying drawings, in which.

DESCRIPTION OF THE PREFERRED EMBODIMENTS

Figure 1:
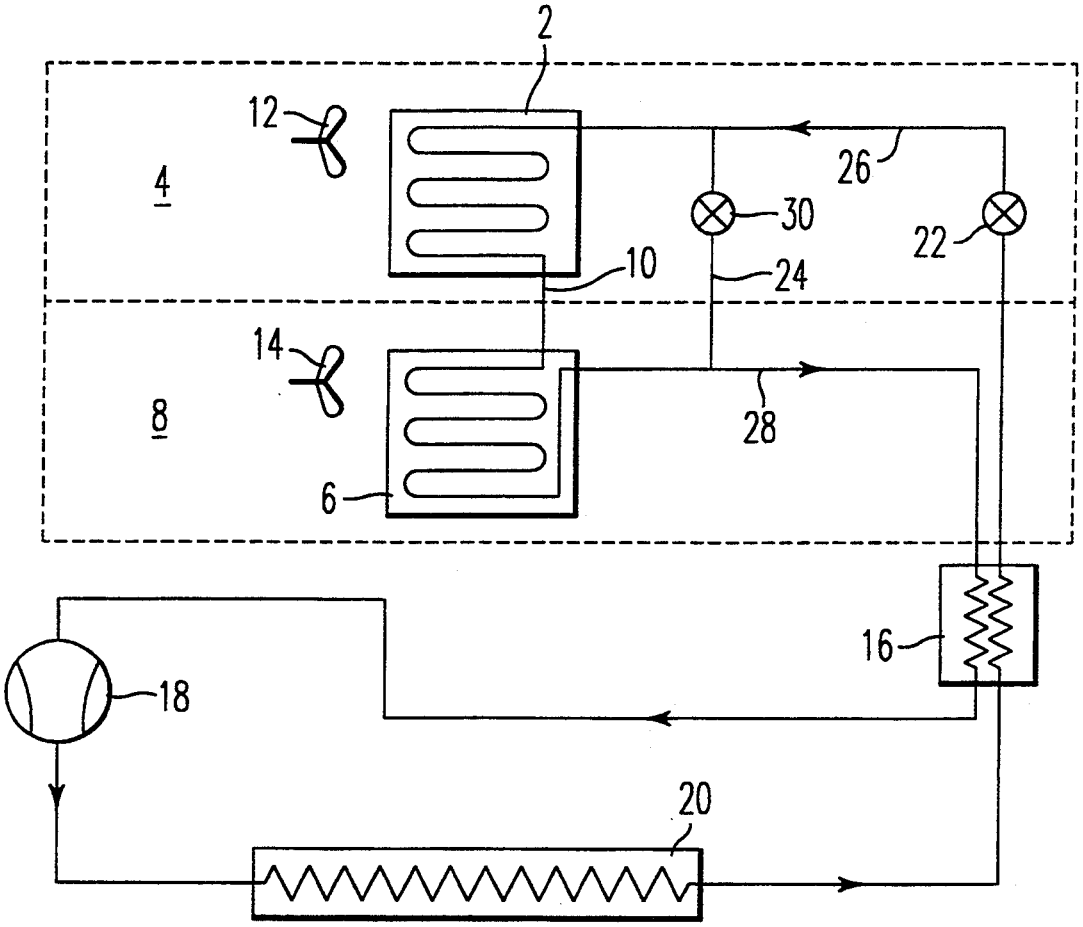
FIG. 1 is a schematic diagram of an embodiment of the refrigeration system of the present invention.

Referring now to FIG. 1, a first exemplary embodiment of the present invention will be described. Although the exemplary embodiments of the present invention will be described with reference to a refrigerator having two cooled storage compartments, as mentioned earlier it is to be understood that the present invention is applicable to arrangements having more than two separate cooled compartments. In addition, the present invention will be described with reference to freezer and fresh food compartments, which are the most common separate compartments in the context of a domestic refrigerator. However, it is also to be understood that the invention is applicable to refrigeration systems other than in the context of a domestic refrigerator, and the separate compartments are not required to be maintained at temperatures associated with frozen and fresh foods.

As shown in FIG. 1, the system includes first and second heat exchangers 2, 6, with the first heat exchanger in the form of a first evaporator 2 which is provided for cooling a freezer compartment 4. The second heat exchanger is also provided in the form of an evaporator 6, and is connected in series with the evaporator 2 for cooling the fresh food compartment 8. Although the fresh food evaporator 6 is shown downstream of the evaporator 2, the freezer compartment evaporator could also be disposed downstream of the fresh food evaporator if desired. A suitable line 10 interconnects the evaporators such that after the refrigerant passes through the freezer evaporator 2, the entirety of the refrigerant flows into the fresh food evaporator 6. Fans are also provided for blowing air across the evaporators 2,6 as represented schematically at 12,14. After exiting the fresh food evaporator, the refrigerant flows through a heat exchanger 16, followed by compressor 18 and condenser 20. The system is shown with the heat exchanger 16, since most domestic refrigeration systems include such a suction line heat exchanger. However, the heat exchanger 16 could be eliminated if desired. Depending upon the system, the condenser 20 may or may not have a fan associated therewith, and both types are commonly used.

After passing through the condenser 20, the refrigerant again passes through the heat exchanger 16, and then passes through a capillary tube 22. The capillary tube 22 is typically in the form of an elongated thin tube approximately 6 feet in length, with the tube usually provided in the form of a coil to conserve space. The purpose of the capillary tube 22 is in restricting the refrigerant flow, as will be discussed further hereinafter. Often, the capillary tube 22 is combined with the heat exchanger 16, with the capillary tube in the form of a coil disposed within the heat exchanger, and most commonly, the capillary tube is soldered to the suction tube (i.e., the tube within the heat exchanger on the suction side) within the heat exchanger. The capillary tube may also be replaced with an expansion valve if desired.

As shown at 24, an optional bypass line may also be provided to connect the inlet 26 of the freezer evaporator 2 with the outlet 28 of the fresh food evaporator 6. A valve 30 is disposed in the line 24 such that the line is closed during normal operation, but is selectively opened during a defrost operation.

When the system is not operating (i.e., the compressor and each of the fans for the evaporators are turned off) the refrigerant in the evaporators will have a higher pressure than the pressure established during operation of the compressor. In addition, once the compressor begins operating, a period of time elapses (e.g., three minutes) during which the pressure is transient, until a steady state pressure is finally achieved. This is primarily due to the action of the capillary tube which restricts the refrigerant flow. By way of example, for refrigerant R12, before the compressor begins operating, the refrigerant will have a pressure of approximately 30 psi. R12 at this pressure is unsuitable for cooling of the freezer compartment since the refrigerant temperature associated at this pressure could actually cause warming of the freezer compartment, or at least inefficient cooling. However, in accordance with the present invention, it has been recognized that even during initial operation of the system, the refrigerant is suitable for cooling the food compartment, and thus energy need not be wasted during the period of time for which the system reaches steady state. Accordingly, in accordance with the present invention, the freezer and fresh food evaporators are disposed in series, with the fresh food compartment fan turned on during the initial operation of a cooling cycle for which the conditions of the refrigerant are transient. After cooling the fresh food compartment, the refrigerant has reached or is near steady state, and the fan 12 for the freezer begins operating while the fan 14 is turned off, and cooling of the freezer compartment is achieved.

The operation of the system will now be described with reference to typical temperatures and pressures of refrigerant R12 merely as an illustration. It is to be understood that other refrigerants may be utilized, and the system may be operated or designed to operate at different pressure/temperature ranges. When each of the freezer and fresh food compartments are at a desired temperature, the system is off, with the fans for the evaporators and the compressor not operating. Due to the action of the capillary tube (or expansion valve) 22, the portion of the system downstream from the capillary tube and upstream of the compressor is referred to as the low pressure side or suction side, while the remainder is referred to as the high pressure side. The pressure on the suction or low pressure side when the system is off is approximately 30 psi. Once the temperature within the fresh food compartment rises above a predetermined temperature, a signal is provided by a thermosensor or thermostat indicating that cooling is needed. Although the temperature of the refrigerant at 30 psi is unsuitable for cooling of the freezer compartment, in accordance with the present invention cooling is provided for the fresh food compartment 8 during the initial operating period of the compressor. Thus, during initial operation after a signal has been received indicating cooling is needed, the fan of the freezer compartment remains off, while the fan 14 of the fresh food compartment is turned on.

During the initial operation, the refrigerant exits the freezer evaporator 2 as a two-phase fluid of vapor and liquid, with approximately 20% vapor and a pressure of 30 psi. The refrigerant is evaporated as it passes through the fresh food compartment and the fresh food compartment is cooled as the fan 14 blows air across the evaporator 6. The refrigerant then exits the evaporator 6 in a gaseous state, and is warmed as it passes through the heat exchanger 16. After passing through the compressor 18, the refrigerant is at a high pressure and high temperature (approximately 140°–180° F.). As the refrigerant passes through the condenser 20, heat is removed by natural convection and/or forced convection if a fan is present. The refrigerant then exits the condenser at approximately the same pressure, however with the refrigerant entirely liquid at a temperature of approximately 90° F. (or approximately 10° F. above ambient). The refrigerant then passes through the heat exchanger 16 which cools the refrigerant to approximately 20°–30° F. below ambient.

Next, the refrigerant passes through the capillary tube 22. The capillary tube ensures that the refrigerant entering the evaporators is in a proper state for effective cooling. However, when the compressor 18 begins operating, the pressure in the low pressure side or suction side is approximately 30 psi, and more refrigerant is entering the capillary tube than exiting the capillary tube. Thus, the pressure does not drop in the low pressure side instantaneously, but rather drops gradually from the initial 30 psi at which the refrigerant is not sufficiently cold for effective cooing of the freezer compartment. After a period of time, the system reaches steady state, such that the pressure in the low pressure side is approximately 10–20 psi. At this time, when sufficient cooling of the fresh food compartment has been achieved, the fan 14 is turned off, and the fan 12 for the freezer evaporator 2 is turned on, and cooling of the freezer compartment is accomplished.

As should be readily apparent from the foregoing, the present invention provides a relatively simple refrigeration system in which the evaporators for the freezer and fresh food compartments operate in tandem, with the fan and evaporator of the fresh food compartment operating during the initial stage of the cooling cycle, followed by operation of the fan/evaporator of the freezer compartment once the system is at or at least near steady state. Experimental results utilizing R12 as the refrigerant have demonstrated an energy savings of approximately 10–20% as compared with the energy requirements of a standard single-stage system.

The fresh food evaporator will typically be larger than the freezer evaporator in terms of total heat exchanger area as well as internal volume. This is typically due to the relative sizes of the fresh food and freezer compartments, since the fresh food compartment is typically larger than the freezer compartment. In addition, the smaller freezer evaporator assists in minimizing the natural convection or free convection which occurs as the warmer transient state refrigerant passes through the freezer evaporator during cooling of the fresh food compartment.

In accordance with the present invention, advantages have also been recognized in accomplishing an effective and efficient defrosting cycle. During this mode of operation, the compressor 18 and freezer fan 12 are turned off, and the fresh food evaporator fan 14 is turned on. In addition, the bypass valve 30 is opened such that the inlet of the freezer evaporator communicates with the outlet of the fresh food evaporator. With the fan 14 operating, the heat from the food compartment is provided to the fresh food evaporator thereby melting any frost which may have accumulated on both evaporators. Although the compressor is not operating during this period, movement of the refrigerant nevertheless occurs as a result of the refrigerant which has been heated and evaporated in the fresh food evaporator 6, and condensed in the freezer evaporator 2. Thus, during the defrosting operation, a thermosiphon effect occurs as the refrigerant is heated and evaporates within the fresh food evaporator 6. The refrigerant vapor is then allowed to pass through the bypass line 24, with the vapor entering the freezer evaporator and accomplishing defrosting or thawing of the ice on the freezer evaporator. As the vapor enters the freezer evaporator 2, liquid from the freezer evaporator also passes along line 10 into the fresh food evaporator 6. Depending upon the respective locations of the fresh food and freezer evaporators, the refrigerant may flow in reverse to that previously discussed, with the vapor passing along line 10 and the liquid refrigerant passing through bypass line 24 and into the fresh food evaporator 6. It should also be understood that the bypass line 24 and valve 30 are optional, and the exchange of vapor and liquid between the evaporators 2,6 may occur in a single line 10. However, for more effective defrosting, if the system is to be operated without the bypass, it is preferred to provide a larger diameter line 10 to allow the exchange of both liquid (from the evaporator 2 to the evaporator 6) and vapor (from the evaporator 6 to the evaporator 2) in line 10.

The defrosting provided by the present invention is advantageous in that a separate heater is not needed to accomplish the thawing or defrosting of ice, resulting in an energy saving of approximately 5% over a conventional electric defrosting system. Particularly by providing a bypass line and valve between the evaporators, the refrigerant can circulate during the defrost mode by the thermosiphon effect. This defrosting is also advantageous in that lower freezer temperatures can be maintained while defrosting is accomplished. With conventional electric defrosting, the freezer compartment often becomes warmer, at times even above freezing, such that softening or melting of items such as ice cream can occur. With the present defrost system, the refrigerant passing through the evaporator effects the defrost, and the temperature within the freezer compartment can be maintained at a lower level.

Figure 2:
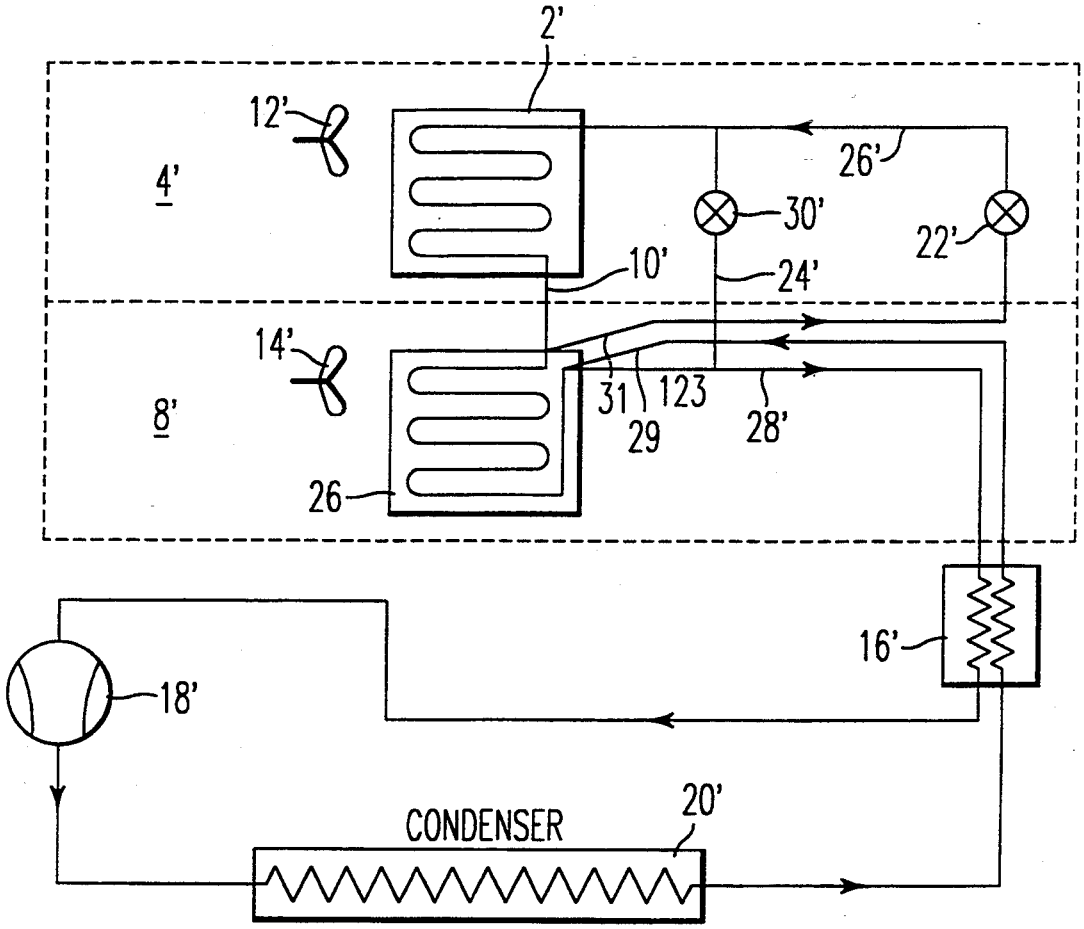
FIG. 2 is an alternate embodiment of the refrigeration system of the present invention.

Referring now to FIG. 2, an alternate embodiment of the present invention will be described. In FIG. 2, elements corresponding to the embodiment of FIG. 1 are indicated with primed numerals, and the description of the corresponding elements is omitted. The system of FIG. 2 is essentially the same as that of FIG. 1 in that a pair of evaporators are provided in series for cooling respective freezer and fresh food compartments 4', 8'. However, in accordance with the FIG. 2 arrangement, an intercooler evaporator 26 is provided for the fresh food compartment. The use of an intercooler evaporator 26 provides for better charge management, and the vapor quality at the downstream side of the capillary tube 22' is reduced to approximately one-half of the vapor quality where a standard evaporator is utilized in the fresh food compartment (i.e., the percentage of vapor at the downstream side of the capillary tube 22' is approximately one-half the percentage of vapor in the FIG. 1 embodiment). In addition to the improved charge management, the precooling of the refrigerant provided by the intercooler evaporator also results in a further energy savings. In contrast to the FIG. 1 arrangement, in which it is possible to incorporate the capillary tube 22 into the heat exchanger 16, the capillary 22' must be provided downstream from the intercooler evaporator 26 as shown in FIG. 2. In other respects, the system of FIG. 2 operates the same as that of FIG. 1. As in the FIG. 1 embodiment, a bypass line 24' and bypass valve 30' can be optionally provided for assisting the defrosting operation.

Figure 3:
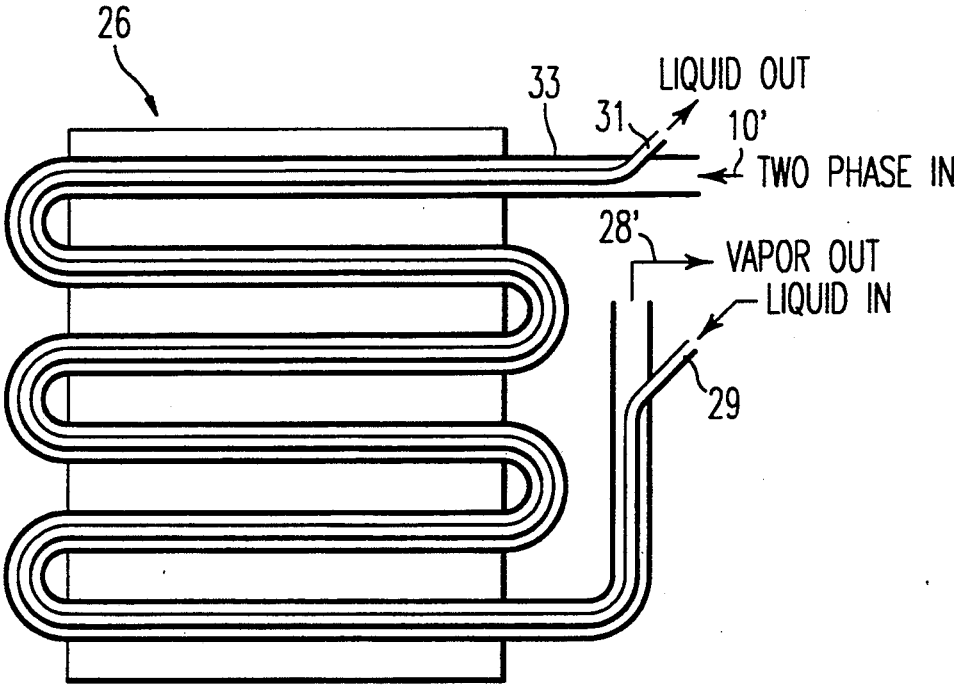
FIG. 3 depicts an intercooler evaporator for use as the fresh food evaporator in the FIG. 2 embodiment.

Referring briefly to FIG. 3, an enlarged view of the intercooler evaporator 26 of the FIG. 2 embodiment is shown. As shown in FIG. 3, the liquid from the heat exchanger 16' enters the evaporator 26 and passes through an internal tube as shown at 29. The liquid then passes through the inner tube, exits as shown at 31, and thereafter passes to the capillary 22'. An additional conduit or tube 33 surrounds the inner tube. The outer tube 33 receives the two-phase refrigerant from the freezer evaporator as indicated at 10'. As the refrigerant is utilized to cool the fresh food compartment 8' the refrigerant evaporates and exits the tube 33 as a vapor as indicated at 28'. As a result of the intercooler arrangement, the two-phase refrigerant exiting the freezer evaporator 2' and entering the evaporator 16 serves not only to provide cooling for the fresh food compartment 8', but also subcools the liquid refrigerant exiting the heat exchanger 16, thereby providing a subcooled refrigerant to the capillary tube 22'. This provides a lower vapor quality refrigerant exiting from the capillary tube, thus improving charge management of the refrigerant and improving the efficiency of the refrigerator.

Figure 4:
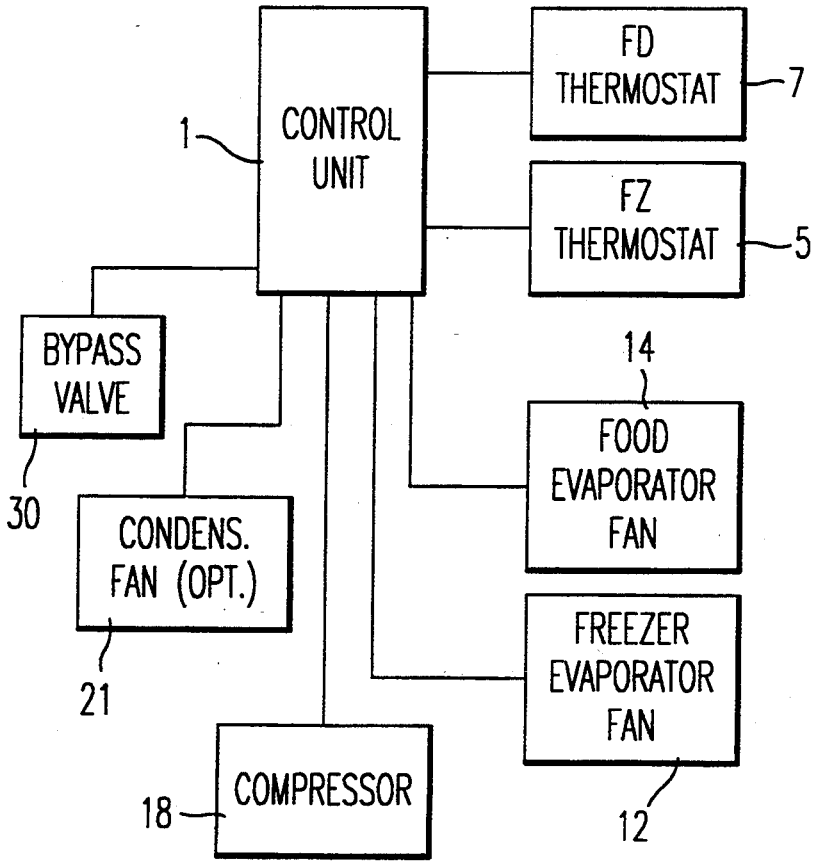
FIG. 4 schematically illustrates a control arrangement for the refrigeration system of the present invention.

Referring now to FIG. 4, a control system for operating the refrigeration system of the present invention is represented. The control unit 1 receives an indication from a sensor or thermostat 7 disposed in the food compartment indicating that cooling is needed. In response, the control unit 1 turns on the food evaporator fan 14, while the freezer evaporator fan 12 is off. The controller ensures that the fans 12, 14 are operated successively and not concurrently, such that only one fan at a time is on. Thus, the controller operates as a two-way switch for the fans during the cooling cycle. Of course, a two-way switch separate from the controller could also be provided for operating the fans, with the controller actuating the two-way switch. In response to the indication from the food compartment thermostat 7 that cooling is needed, the control unit 1 also initiates operation of the compressor 18 as well as the fan 21 for the condenser (if the condenser is equipped with a fan). After it has been determined that the food compartment is sufficiently cooled, either by a signal provided by the thermostat, or after a period of time has elapsed, the food compartment fan 14 is turned off, and the freezer compartment fan is turned on, and cooling of the freezer compartment takes place until it is determined that the freezer compartment is sufficiently cooled at which time the freezer fan, compressor and condenser fan (if provided) are turned off. Thus, cooling of the food compartment is achieved during the initial operating period of the compressor at which time the condition of the refrigerant flowing through the evaporators is transient, while the freezer compartment, is cooled after cooling of the food compartment such that the freezer compartment cooling is achieved when the refrigerant has reached a state which is more favorable for cooling of the freezer compartment.

During the defrost operation, the compressor and freezer evaporator fan are off, while the food evaporator fan 14 is on, and the bypass valve 30 (if present) is opened. The operation of the defrost cycle can occur periodically or at a predetermined time (e.g., at nighttime while the refrigerator is typically closed), or may be based upon sensors or logic indicating that defrosting is needed.

For the situation in which the freezer thermostat indicates that cooling is needed, while the food thermostat does not indicate cooling is needed, the system can operate the same as previously discussed, with an initial cooling of the food compartment followed by cooling of the freezer compartment. Alternatively, a separate routine could also be provided for cooling of the freezer compartment only, possibly with the provision for an elapsed period of time occurring after the compressor begins operating and prior to operation of the freezer evaporator fan 12.

As should be readily apparent from the foregoing, the present invention provides a relatively simple, yet efficient refrigeration system which is particularly suitable for cooling two or more compartments which are to be maintained at a different temperatures. The present invention also provides a reliable and efficient defrosting operation which does not require the use of auxiliary heaters to thaw or defrost ice which can accumulate on the heat exchangers or evaporators provided for each of the compartments.

Obviously, numerous modifications and variations of the present invention are possible in light of the above teachings. It is therefore to be understood that within the scope of the appended claims, the invention may be practiced otherwise than as specifically described herein.

What is claimed as new and is desired to be secured by letters patent of the U.S. is:

1. A refrigeration system for cooling at least two compartments comprising:

a compressor;

a condenser;

a first compartment to be cooled, said first compartment including a first heat exchanger and a first fan associated therewith;

a second compartment to be cooled including a second heat exchanger and a second fan associated therewith, wherein said first compartment is to be maintained at a temperature lower than said second compartment; and a control system for controlling the compressor, the first fan and the second fan, said control system turning on said second fan and said compressor in response to a signal indicating cooling is needed in one of said first and second compartments, and after cooling is achieved in said second compartment, said control system turns said second fan off and turns said first fan on for cooling said first compartment;

wherein said first and second heat exchangers are arranged in series, with one of said first and second heat exchangers disposed upstream of the other of said first and second heat exchangers, and wherein said first and second heat exchangers are connected to one another such that refrigerant exiting said one of said heat exchangers flows directly and completely into said other of said heat exchangers.

2. The refrigeration system of claim 1, wherein said first and second heat exchangers comprise respective first and second evaporators.

3. The refrigeration system of claim 1, further including first and second thermostats disposed respectively in said first and second compartments for providing signals to said control system for maintaining said first and second compartments within desired temperature ranges, and wherein said first thermostat is set to maintain said first compartment at a temperature lower than said second compartment.

4. A refrigeration system for cooling at least two compartments comprising:

a compressor;

a condenser;

a first compartment to be cooled, said first compartment including a first heat exchanger and a first fan associated therewith;

a second compartment to be cooled including a second heat exchanger and a second fan associated therewith, wherein said first compartment is to be maintained at a temperature lower than said second compartment; and a control system for controlling the compressor, the first fan and the second fan, said control system turning on said second fan and said compressor in response to a signal indicating cooling is needed in one of said first and second compartments, and after cooling is achieved in said second compartment, said control system turns said second fan off and turns said first fan on for cooling said first compartment;

wherein a bypass line is disposed between a refrigerant inlet of said first heat exchanger and a refrigerant outlet of said second heat exchanger, and further wherein a valve is disposed in said bypass line.

5. The refrigeration system of claim 4, wherein said control system opens said valve for a defrosting operation, said control system further turning on said second fan while maintaining said first fan and said compressor off for said defrosting operation.

6. A refrigeration system for cooling at least two compartments comprising:

a compressor;

a condenser;

a first compartment to be cooled, said first compartment including a first heat exchanger and a first fan associated therewith;

a second compartment to be cooled including a second heat exchanger and a second fan associated therewith, wherein said first compartment is to be maintained at a temperature lower than said second compartment; and a control system for controlling the compressor, the first fan and the second fan, said control system turning on said second fan and said compressor in response to a signal indicating cooling is needed in one of said first and second compartments, and after cooling is achieved in said second compartment, said control system turns said second fan off and turns said first fan on for cooling said first compartment;

wherein said second heat exchanger is an intercooler evaporator, said intercooler evaporator including a first conduit receiving liquid refrigerant after said liquid refrigerant exits said condenser, said first conduit connected to a refrigerant inlet of said first heat exchanger, said intercooler evaporator further including a second conduit connected to a refrigerant outlet of said first heat exchanger for receiving two-phase refrigerant from said first heat exchanger, whereby the two-phase refrigerant of said second conduit cools said liquid refrigerant of said first conduit.

7. The refrigeration system of claim 6, further including one of an expansion valve and a capillary tube disposed between said inlet of said first heat exchanger and said first conduit of said intercooler evaporator.

8. A method for refrigerating first and second compartments to maintain the first and second compartments at different temperatures with the first compartment to be maintained at a cooler temperature than said second compartment, the method comprising:

providing a first evaporator and a first fan for cooling said first compartment;

providing a second evaporator and a second fan for cooling said second compartment;

operating a cooling cycle in response to a determination that cooling is needed in at least one of said first and second compartments, wherein said second fan is initially operated during said cooling cycle while said first fan is off, and thereafter said second fan is turned off and said first fan is turned on;

the method further including disposing said first and second evaporators in series, with one of said first and second evaporators upstream of the other of said first and second evaporators, the method further including flowing the entire refrigerant flow exiting said one of said evaporators into the other of said evaporators.

9. The method of claim 8, further including operating a compressor upon initiation of said cooling cycle, such that said second fan operates during the initial operation of said compressor, and such that during operation of said second fan refrigerant passing through the first and second evaporators is transient, the method further including operating said first fan when said refrigerant is at steady state.

10. A method for refrigerating first and second compartments to maintain the first and second compartments at different temperatures with the first compartment to be maintained at a cooler temperature than said second compartment, the method comprising:

providing a first evaporator and a first fan for cooling said first compartment;

providing a second evaporator and a second fan for cooling said second compartment;

operating a cooling cycle in response to a determination that cooling is needed in at least one of said first and second compartments, wherein said second fan is initially operated during said cooling cycle while said first fan is off, and thereafter said second fan is turned off and said first fan is turned on;

the method further including providing a bypass line between a refrigerant inlet of said first evaporator and a refrigerant outlet of said second evaporator with a valve disposed in said bypass line, the method further including maintaining said valve in a closed condition during cooling operations, and opening said valve for a defrosting operation.

11. The method of claim 10, further including turning said second fan on while maintaining said first fan and a compressor off during said defrosting operation.

12. A method for refrigerating first and second compartments to maintain the first and second compartments at different temperatures with the first compartment to be maintained at a cooler temperature than said second compartment, the method comprising:

providing a first evaporator and a first fan for cooling said first compartment;

providing a second evaporator and a second fan for cooling said second compartment;

operating a cooling cycle in response to a determination that cooling is needed in at least one of said first and second compartments, wherein said second fan is initially operated during said cooling cycle while said first fan is off, and thereafter said second fan is turned off and said first fan is turned on;

the method further including providing an intercooler evaporator as said second evaporator and utilizing said intercooler evaporator for cooling the refrigerant before the refrigerant flows into said first evaporator.

13. The method of claim 12, further including providing at least one of an expansion valve and a capillary tube disposed along a conduit connecting said intercooler evaporator and said first evaporator.

14. A refrigeration system comprising:

a first evaporator;

a second evaporator connected in series with said first evaporator;

first and second fans respectfully associated with said first and second evaporators; and a two-way switch connected to said first and second fans such that only one of said fans is operated at a time.

15. The refrigeration system of claim 14, wherein an outlet of said first evaporator is connected to an inlet of said second evaporator such that refrigerant exiting said first evaporator flows directly and completely into said second evaporator.

16. The refrigeration system of claim 15, further including first and second compartments, wherein said first evaporator cools said first compartment and said second evaporator cools said second compartment, said system further including control means for operating said two-way switch such that during a cooling cycle said second fan is initially operated followed by operation of said first fan.

17. The refrigeration system of claim 16, wherein said control means also controls operation of a compressor, said control means turning said compressor on to initiate said cooling cycle, with said second fan operating during the initial operation of said compressor, said control means also effecting a defrosting cycle during which said control means maintains said compressor and said first fan in an off condition, while said control means turns said second fan on to effect defrosting.

18. The refrigeration system of claim 17, further including a bypass line connected between an inlet of said first evaporator and an outlet of said second evaporator, said bypass line including a valve disposed therealong, and wherein said control means opens said valve during a defrosting operation.

* * * * *

UNITED STATES PATENT AND TRADEMARK OFFICE

CERTIFICATE OF CORRECTION

PATENT NO. : 5,406,805
DATED : April 18, 1995
INVENTOR(S) : K. Reinhard H. RADERMACHER, et al.

It is certified that error appears in the above-indentified patent and that said Letters Patent is hereby corrected as shown below:

On the title page, Item [73], the second Assignee should read:

--The United States Environmental Protection Agency--

Signed and Sealed this

Eleventh Day of July, 1995

*Attest:*

*Attesting Officer*

Bruce Lehman

BRUCE LEHMAN

*Commissioner of Patents and Trademarks*